United States Patent [19]

Stahlecker

[11] Patent Number: 4,563,872

[45] Date of Patent: Jan. 14, 1986

[54] START SPINNING ARRANGEMENT FOR AN OPEN END FRICTION SPINNING MACHINE

[75] Inventor: Fritz Stahlecker, Josef-Neidhart-Strasse 18, 7347 Bad Ueberkingen, Fed. Rep. of Germany

[73] Assignees: Fritz Stahlecker, Fed. Rep. of Germany; Hans Stahlecker, Fed. Rep. of Germany

[21] Appl. No.: 604,373

[22] Filed: Apr. 26, 1984

[30] Foreign Application Priority Data

Apr. 26, 1983 [DE] Fed. Rep. of Germany ..... 3315034

[51] Int. Cl.[4] ..... D01H 15/02

[52] U.S. Cl. ..... 57/263; 57/261; 57/401; 57/405; 57/407

[58] Field of Search ..... 57/261, 267, 400, 401, 57/405, 407

[56] References Cited

U.S. PATENT DOCUMENTS

| | | | |
|---|---|---|---|
| 4,083,171 | 4/1978 | Konig et al. | 57/263 |
| 4,089,155 | 5/1978 | Stahlecker | 57/263 |
| 4,107,957 | 8/1978 | Stahlecker et al. | 57/263 |
| 4,120,140 | 10/1978 | Raasch et al. | 57/263 |
| 4,202,163 | 5/1980 | Turk et al. | 57/401 |
| 4,367,623 | 1/1983 | Parker et al. | 57/401 X |

*Primary Examiner*—John Petrakes

*Attorney, Agent, or Firm*—Barnes & Thornburg

[57] ABSTRACT

A process and apparatus is disclosed for improving the start-spinning of yarn on an open end friction spinning machine. To facilitate an exact alignment of the return yarn end to be pieced up with newly supplied incoming fibers, the respective spinning units are provided with a moveable cover part which in the open position exposes the yarn forming wedge slot between the friction rollers. Devices are provided for returning the yarn end and holding the same at a slight spacing from the friction rollers at the wedge slot and for sequentially timing the yarn draw off during start spinning with the activation of the fiber feed and the suction air flow related thereto.

41 Claims, 17 Drawing Figures

FIG.14
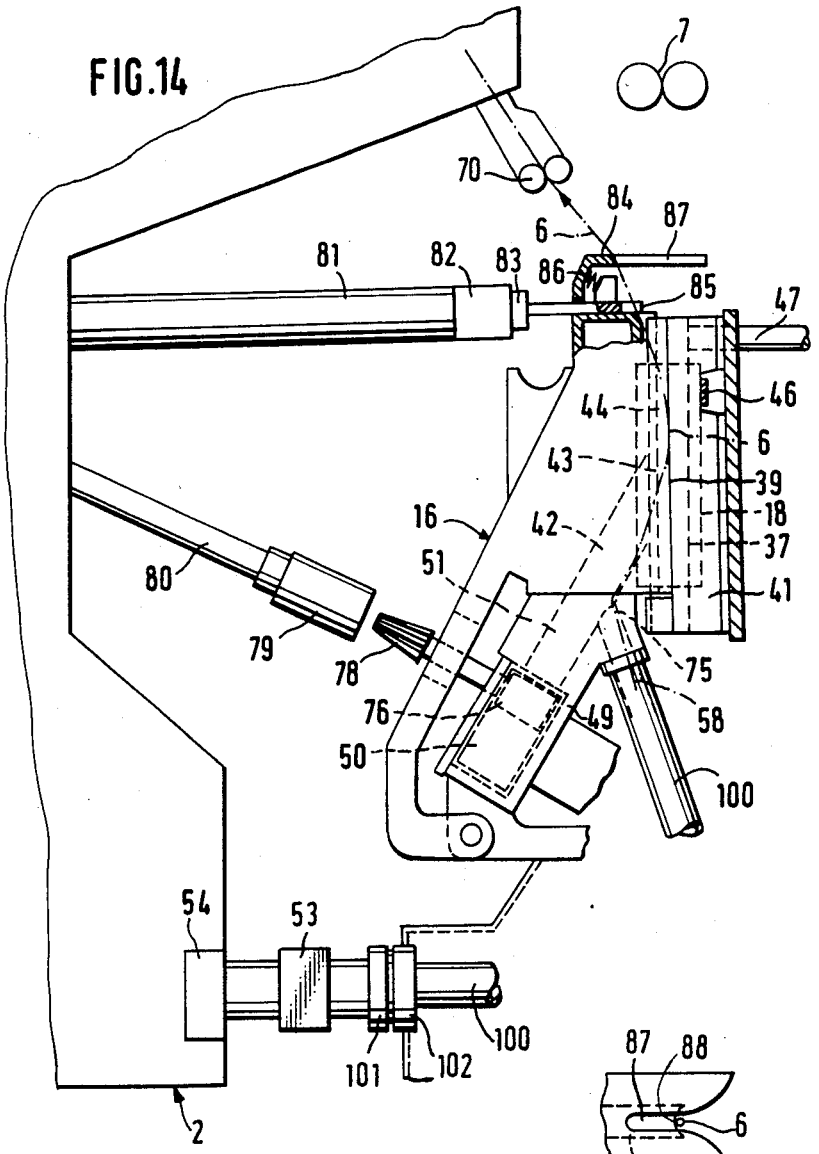
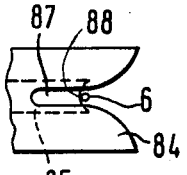
FIG. 14A

START SPINNING ARRANGEMENT FOR AN OPEN END FRICTION SPINNING MACHINE

BACKGROUND AND SUMMARY OF THE INVENTION

The invention relates to a method and apparatus for start spinning of yarn at a spinning unit of an open-end friction spinning machine, which unit is provided with two adjacently arranged rollers, driven in the same rotational direction and forming a wedge throat or slot therebetween. An inlet and opening device for feeding single fibers to the wedge slot, a yarn withdrawal device for drawing off the produced yarn in the direction of the wedge slot and a suction device for holding of yarn to be produced within the wedge slot are also included for the spinning unit. For the process of start spinning, an already spun yarn end is returned and first brought to a position at a distance from the wedge slot and is subsequently delivered to the wedge slot. The delivery of single fibers interrupted earlier is resumed and the yarn is drawn off.

This application is related to application Ser. No. 604,377, filed on even date herewith and based upon the same German patent application No. P 33 15 034.6.

A start spinning process for a spinning unit of an open end friction spinning machine is known in European Published application (EP-OS) No. 34 427 which can be executed manually, whereby a yarn end which was stretched to reach the supply position, is returned over a yarn withdrawal tube in the closed spinning unit. This process requires that special steps at the spinning unit are taken to achieve that the yarn end, while in an outstretched condition, is first brought into a position at a distance from the wedge slot and is then carried into the wedge slot in said extended or straightened condition. This construction allows the yarn end to be returned essentially over the circumference of a self-suctioned drum or roller rotating towards the wedge slot, which roller delivers the yarn end into the wedge slot. Then the fiber feed is switched on. Thereafter the yarn withdrawal device resumes operation. The known process is difficult to execute and offers no real control as to whether the yarn end actually reaches the area of fiber supply. Because the wedge slot is not exposed and not visible there is no control possible. In addition, there is always the danger that the yarn end running over the roller which rotates towards the wedge slot, will assume an uncontrollable position.

The invention is based on the problems of providing an arrangement of the kind described above which makes the safe return of a yarn end to a start spinning process possible, while it is positively assured that the yarn end actually reaches the area in which the supply of fibers take place, i.e., in the area of fiber supply.

These problems are solved according to the invention by exposing the wedge slot prior to the return of the yarn end by movement of a cover-like element, whereby said yarn end is brought into a position between the wedge slot and said cover-like element. The yarn end then is transferred to an area immediately next to the wedge slot, whereby the actual start spinning process is initiated by switching on the yarn withdrawal device, by transfer of the yarn end to the wedge slot, and by activating the fiber feed supply.

This arrangement allows controllable transfer of the yarn end prior to the start spinning process, so that a yarn end to be start spun actually exists in the area of supply to which fibers can be attached. Control of the return of the yarn end is easily possible since the spinning unit is opened prior to the start spinning and yarn end insertion processes. The necessary operations are made without hinderance so that especially also automatically operating devices can be utilized.

In further arrangements of the invention it is provided that the supply of fibers is activated at the time the yarn end is in the area of fiber feed after the end is returned over the length of the wedge slot and subsequently the yarn is removed through the same path. It is thereby possible to provide a qualitative improvement in the start spinning location.

To be provided with a start spinning yarn portion that differs as little as possible from the rest of the yarn, a further arrangement of the invention provides that a decreased amount of fiber material is supplied during start spinning, compared with the amount during normal operation until the withdrawal of the yarn end from the area of fiber feed. This measure permits to further enhance the quality of the start spinning section of the yarn and, especially reduces the yarn thickening to an absolute minimum before the actual start spinning section of the yarn. This particular measure is certainly also attainable according to certain embodiments where the spinning unit is not opened for inserting in the yarn end.

In further arrangements of the invention means are provided to at least partially free the yarn end from the spinning rotation before the same reaches the area of fiber feed. This allows a very fine connection between the newly supplied (fed in) fibers and the yarn end so that the quality of the start spinning portion of the yarn is even further improved. The amount of fibers first introduced and surrounding or covering the yarn end are reduced to a minimum. This operational step is certainly also usable if the spinning unit is not opened for the withdrawal of the yarn end, according to certain preferred embodiments of the invention.

In order to avoid thickening in the area of start spinning, another arrangement of the invention provides that the yarn end is withdrawn with a differing speed of withdrawl as compared to the operational speed, until the end of the yarn end has left the area of fiber feed. This even further reduces the possibility of yarn thickening and offers special advantages in connection with control of the amount of fiber feed-in during the start spinning process.

A further arrangement of the invention provides that the yarn is held at a distance to the wedge slot and without touching the roller surfaces and is only transferred to the wedge slot shortly prior to the actual start spinning process, when the end of the yarn end reaches the area of fiber feed. It is thereby attained that the yarn end transferred to the wedge slot does not achieve high spinning rotation compared with the yarn spun during operational provisions which could otherwise change the characteristics and also complicate the start spinning process. This measure is certainly also possible without opening the spinning unit to position the yarn end, according to certain preferred embodiments of the invention.

In preferred embodiments, apparatus for accommodating the start spinning process is accommodated in a mobile maintenance device that is selectively positionalbe adjacent respective spinning units of a spinning machine.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 14 shows the spinning unit and maintenance device according to FIG. 13 in a position shortly prior to execution of the actual start spinning by again activating the supply and withdrawal of the yarn end;

FIG. 14A is a detail of the embodiment according to FIGS. 13 and 14 in the area of a thread carrier.

DETAILED DESCRIPTION OF THE DRAWINGS

Figure 1:
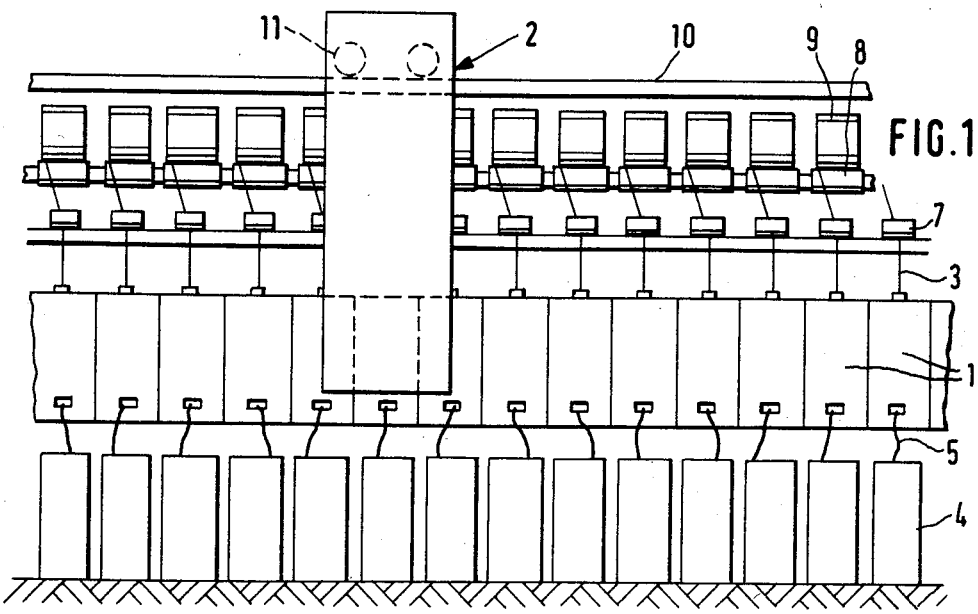
FIG. 1 is a partial front schematic view of an open end friction spinning machine with a multitude of spinning units and with a movable maintenance device for accomodating a start spinning process.
Figure 2:
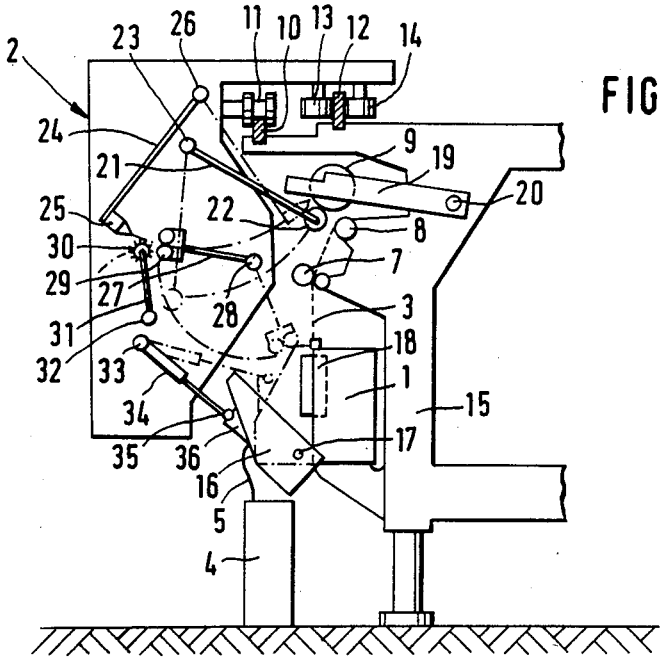
FIG. 2 is a schematic depiction of a cross-section through the open end friction spinning machine and the maintenance device of FIG. 1.

The illustrated open end friction spinning machine (FIGS. 1 and 2) includes a plurality of adjacently arranged spinning units in a row, advantageously arranged in rows at both sides of the spinning machine, which spinning units among themselves are similarly constructed. These spinning units 1 are maintained by a movable maintenance device 2 by processes described below. The maintenance device 2 is arranged to be longitudinally movable on tracks 10 and 12 of the open end friction spinning machine by means of track rollers 11, 13, and 14. The maintenance device 2 is provided with arrangements for recognizing a need for maintenance, which arrangements are not further illustrated, for example, arrangements for detecting a yarn break. The maintenance device 2 is controlled to then stop at the respective spinning unit 1 needing maintenance and to perform the maintenance operation.

At each spinning unit 1 a fiber band or sliver 5 is taken from a can 4 to be spun to a yarn 3. Yarn 3 is withdrawn by means of a pair of draw-off rollers 7 and wound on spools 9. The pair of draw-off rollers 7 include respectively a driven cylinder extending in the machine longitudinal direction and resiliently biased compression roller means. The spool 9 is held by a spool frame 19 pivotable about an axle 20, and positioned upon a driven grooved drum 8.

Figure 4:
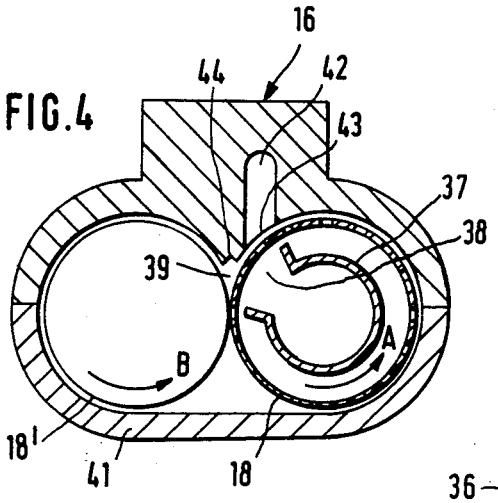
FIG. 4 is a sectional view along line IV—IV through the spinning unit of FIG. 3.
Figure 3:
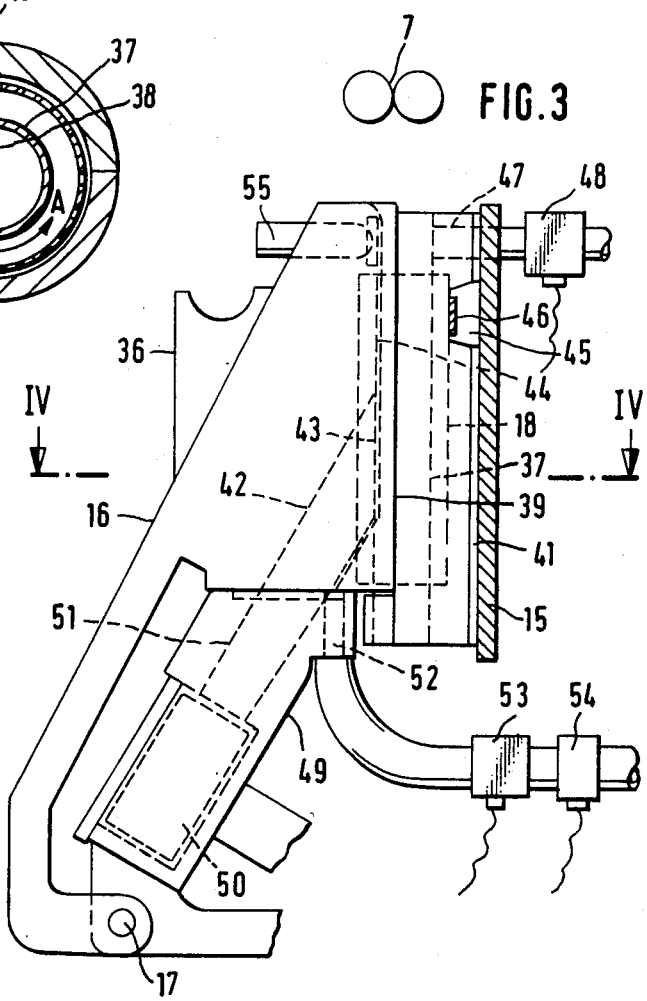
FIG. 3 is a side view of a spinning unit constructed in accordance with a preferred embodiment of the invention shown only partially and in an enlarged scale.

Each spinning unit 1 (FIGS. 3 and 4) includes two rollers 18 and 18′ driven by means of tangential belt 46 in the same rotational direction, i.e., direction of arrow A and B in FIG. 4, which rollers 18 and 18′ together form a wedge slot 39 between them in which the yarn is produced. In the illustrated embodiment one of the two rollers, namely roller 18, is constructed as a so-called suction roller. Said suction roller features a shell or coating perforated with holes and a suction insert 37 arranged on its inside. Suction insert 37 is connected to a vacuum or underpressure source and is open towards the area of the wedge slot 39 via a gap or slot opening 38. The other roller 18′, which is only generally illustrated in shape, could also be a suction roller or could even be arranged as a roller with a closed shell featuring, if need be, a coating or a profile, according to alternative preferred embodiments of the invention. Rollers 18, 18′ are arranged in a bearing housing 41 which is fixedly attached to a machine frame 15. Bearing housing 41 features a cut-out 45 in which a tangential belt 46 is arranged which runs in the longitudinal direction of the machine, and engages respective outside shell surfaces (coating surfaces) of rollers 18 and 18′ of all spinning units at a side of the spinning machine, and drives said spinning units respectively. With the illustrated embodiment, the rollers 18 and 18′ are positioned on tube-shaped suction inserts 37 which are closed on both ends and connected by means of a connector 47 to a vacuum or underpressure source featuring a control valve 48.

Rollers 18 and 18′ are covered at least in the area of wedge slot 39 by means of a cover-like, removable element 16 supported at the bearing housing 41 while in a closed position. The cover-like element 16 is provided with half shell shaped protrusions conforming with the contours of rollers 18 and 18′. Said element 16 could be provided in a not further illustrated manner with air intake openings, arranged especially in the area of roller 18′ rotating away from wedge slot 39. Said openings could advantageously facilitate a predetermined airstream in the area of the wedge slot 39.

The cover-like housing element 16 includes a part 42 of a fiber feed channel which opens with opening 43 in the area of wedge slot 39. Opening 43 is preferably positioned close to the wedge slot 39 opposite the cover surface of roller 18 rotating into wedge slot 39. The other first part 51 of the fiber feed channel is disposed in a fixedly arranged housing 49, in which an opening roller 50 and a feed roller 76 (compare FIGS. 13 and 14) are arranged, forming an inlet-and opening device which aid in the opening of fiber band 5 into single fibers. These single fibers are fed to the area of wedge slot 39. Similar inlet-and opening devices are known with open end rotor spinning arrangements. The thread produced within wedge slot 39 is withdrawn by means of respectively arranged draw-off roller pair 7. Cover-like element 16 is pivoted by means of a pivot axle 17 in such a manner so as to completely expose the area of wedge slot 39 between rollers 18 and 18'. Pivot axle 17 is preferably located below the inlet-and opening device and extends in the machine longitudinal direction.

Each spinning unit includes a thread break sensor which is not further illustrated, arranged between rollers 18, 18' and the draw-off roller pair 7, or alternatively between draw-off roller pair 7 and grooved drum 8. In response to a yarn break, the sensor interrupts the further intake of fiber band by uncoupling the feed roller (feed roller 76 in FIGS. 13 and 14) from its central drive, whereby the drive of each feed roller includes one switch coupling respectively. It is also contemplated in certain preferred embodiments to interrupt the supply of the fiber band by providing that a feed table cooperating with the feed roller is pivoted away from the feed roller with fixed clamping of the fiber band. Additionally, the thread break sensor activates a control signal, for example a light (lamp) provided for each spinning unit, said control signal being arranged for detection by the respective detector of maintenance device 2. Maintenance device 2 is thereby called to spinning unit 1 which requires maintenance, and attends to the necessary maintenance process. If need be, the thread detector could activate a mechanism provided in each spinning unit, which pivots spool frame 19 and lifts it off grooved roller 8 upon detection of a thread break. During a single thread break, at one or several spinning units, the drives of the remaining units are not interrupted, meaning that opening rollers 50, rollers 18 and 18', draw-off rollers 7, and grooved roller 8 are driven with unchanged rotational speed. The necessary maintenance process is then conducted by maintenance device 2 when called and when disposed at the respective spinning unit 1 to be serviced.

Maintenance device 2 (FIG. 2) first opens up the spinning unit 1 by pivoting the movable cover-like element 16. Said maintenance device 2 is therefore provided with, for example a hydraulic press 34, engageable by means of a ball head 35 with an accordingly designed receiver part 36 of element 16. The hydraulic press 34 then pivots element 16 about its pivot axle 33 by means of a motor drive. Before the actual process of start spinning, the spinning unit 1, especially rollers 18 and 18', are now cleaned, since contamination in this region was possibly the reason for the thread break. Such cleaning process is relatively easy to automatically perform with suitable means of maintenance device 2 because wedge slot 39 is exposed.

Maintenance device 2 then effects a withdrawal or return of a suitable yarn end 6 to the area of wedge slot 39. To accomodate this process maintenance device 2 is provided with a lift-off roller 22 which is drivable in both rotational directions. The lift-off roller 22 is arranged on pivot arm 21 which is pivotable by means of a motor drive in such a manner about a pivot axle 23 to position the lift-off roller 22 with the take-up spool 9. In the event the spool frame 19 is not to be moved by means ay the spinning unit 1, lift-off roller 22 will then lift the take-up spool 9 along with the spool frame 19 off the grooved roller 8. Lift-off roller 22 then drives the take-up spool 9 in opposite direction to the normal take-up direction. Take-up spool 9 is then coordinated with a seeking nozzle or device 25 arranged on pivot arm 24 and pivotable by means of a motor drive around pivot axle 26 so that seeking device 25 is movable to the circumferance of take-up spool 9. The seeking device 25 then pivots with the so-found yarn end 6 away from the take-up spool 9 and deposits this yarn end 6 into a subsidiary draw-off roller pair 29 opened by means of separation of the rollers. During the process of withdrawal of the yarn end by means of seeking device 25, take-up spool 9 is further advantageously driven by means of lift-off roller 22 in the direction of lift-off. The subsidiary draw-off roller pair 29 is then closed, meaning both rollers adjacently are positioned so that the yarn end 6 is clamped in between them. The yarn end 6 now positioned between seeking device 25 and subsidiary draw-off roller pair 29, is brought in contact with a straightening device which device is preferably provided with a driven friction wheel 30 positioned on pivot arm 31 to be pivotable about pivot axle 32 by means of a motor drive. The yarn end is so positioned by means of friction wheel 30 whereby at the same time its actual end is formed to a fiber beard-like end 58 (FIGS. 5, 6).

Figure 5:
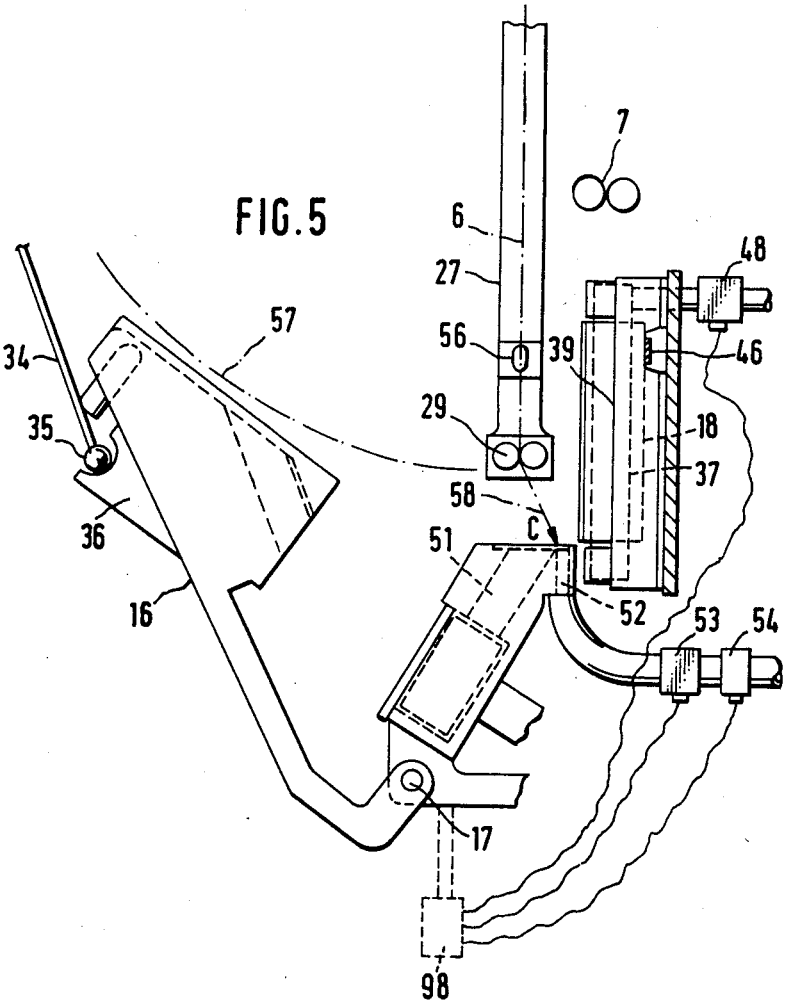
FIG. 5 is a side view of the spinning unit of FIG. 3 opened by means of pivoting a cover-like element during the first phase of withdrawal of a yarn end, according to the present invention.
Figure 6:
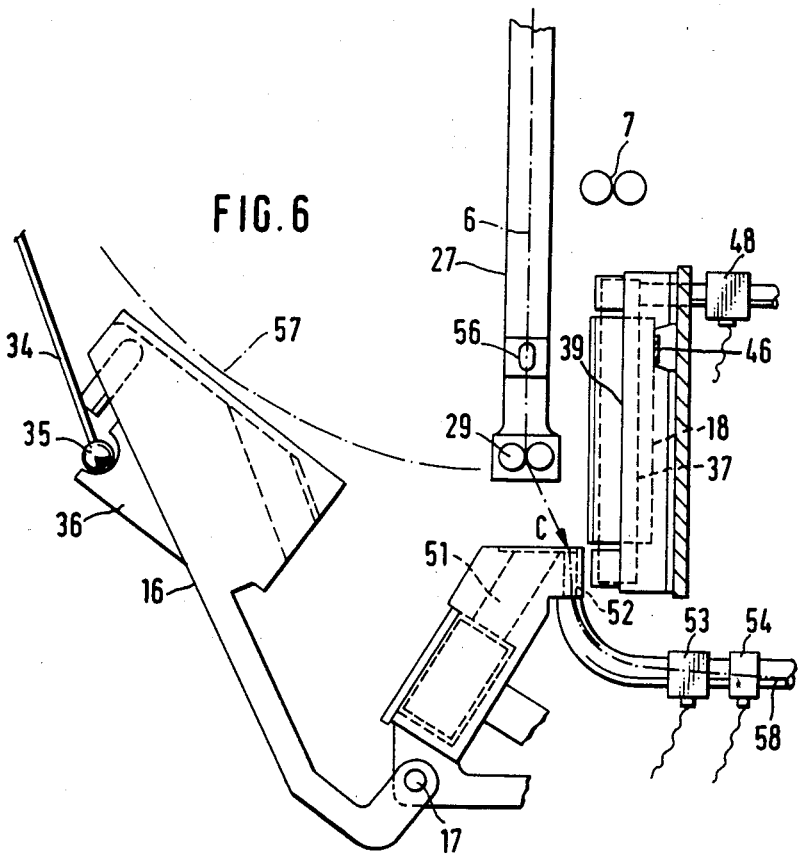
FIG. 6 shows the spinning unit according to FIG. 5 during the second phase of withdrawal.

Subsidiary draw-off roller pair 29 holding the yarn end 6 with its bearded end 58 is then moved to spinning unit 1 (FIG. 5). For this purpose, subsidiary draw-off roller pair 29 is arranged on pivot arm 27 which is pivotable about an axle 28 by means of a motor drive and movable to adjacent the opened spinning unit 1 (FIG. 5). Subsidiary draw-off roller pair 29 serving as a first thread carrier guide element, is pivoted in the direction of spinning unit 1 so far as to carry the end 58 of yarn end 6 in the area of a second thread carrier guide element formed as a stationary suction device 52 provided in housing 49. Suction device 52 is arranged in the area of the ends of rollers 18 and 18' facing away from draw-off rollers 7. Suction device 52 is connected to an underpressure source including a switch valve 53 (relay valve) which underpressure connection effects sucking in of yarn end 6 as soon as subsidiary draw-off rollers 29 and simultaneously also the lift-off roller 22 are driven in the direction of draw-off. Maintenance device 2 advantageously controls the switching on of suction element 52 by means of a control valve 53 whereby a connecting line is established from control valve 53 to switch 98 which is attached to a switch element or control element of maintenance device 2. The yarn end 6 is introduced into suction element 52 with a greater length which extends about the axial length of roller 18. The return of yarn end 6 is determined by the switch on time of subsidiary draw-off rollers 29 and lift-off roller 22. It is also contemplated, to signal the sufficient return of yarn end 6 (FIG. 6) to maintenance device 2 by means of a control device 54 which advantageously is connected to the same switching unit 98 which also connects to the control valve 53. A further draw-off of yarn end 6 is thereby interrupted. In order obtain reliable control over the amount of returned yarn end 6 as illustrated in FIGS. 5 and 6, device 56 could be provided for marking yarn end 6 in a specific, defined distance to the actual yarn end 58. This device 56 is arranged upon pivot arm 27 of subsidiary draw-off roller 29. This device could spray the yarn end 6 with a material which essentially deviates in its optical, acoustical or especially electrical characteristics from the fiber material, and can therefore easily be detected by control device 54.

Figure 7:
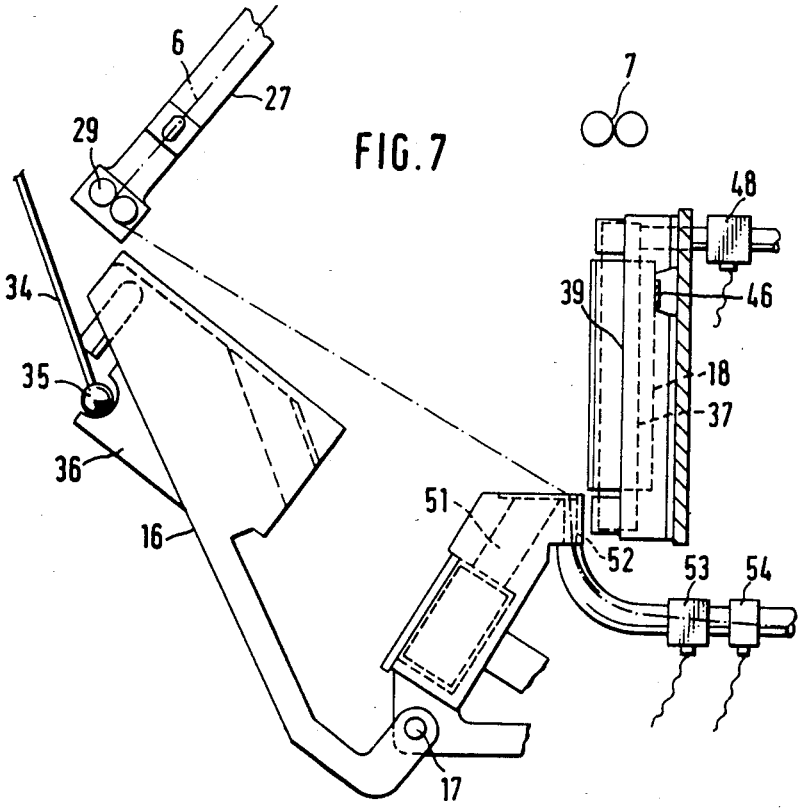
FIG. 7 is a side view of the spinning unit of FIG. 3 during the tensioning of the withdrawn yarn end in a straight line between a wedge slot of a friction roller pair and the pivoted cover-like element.
Figure 8:
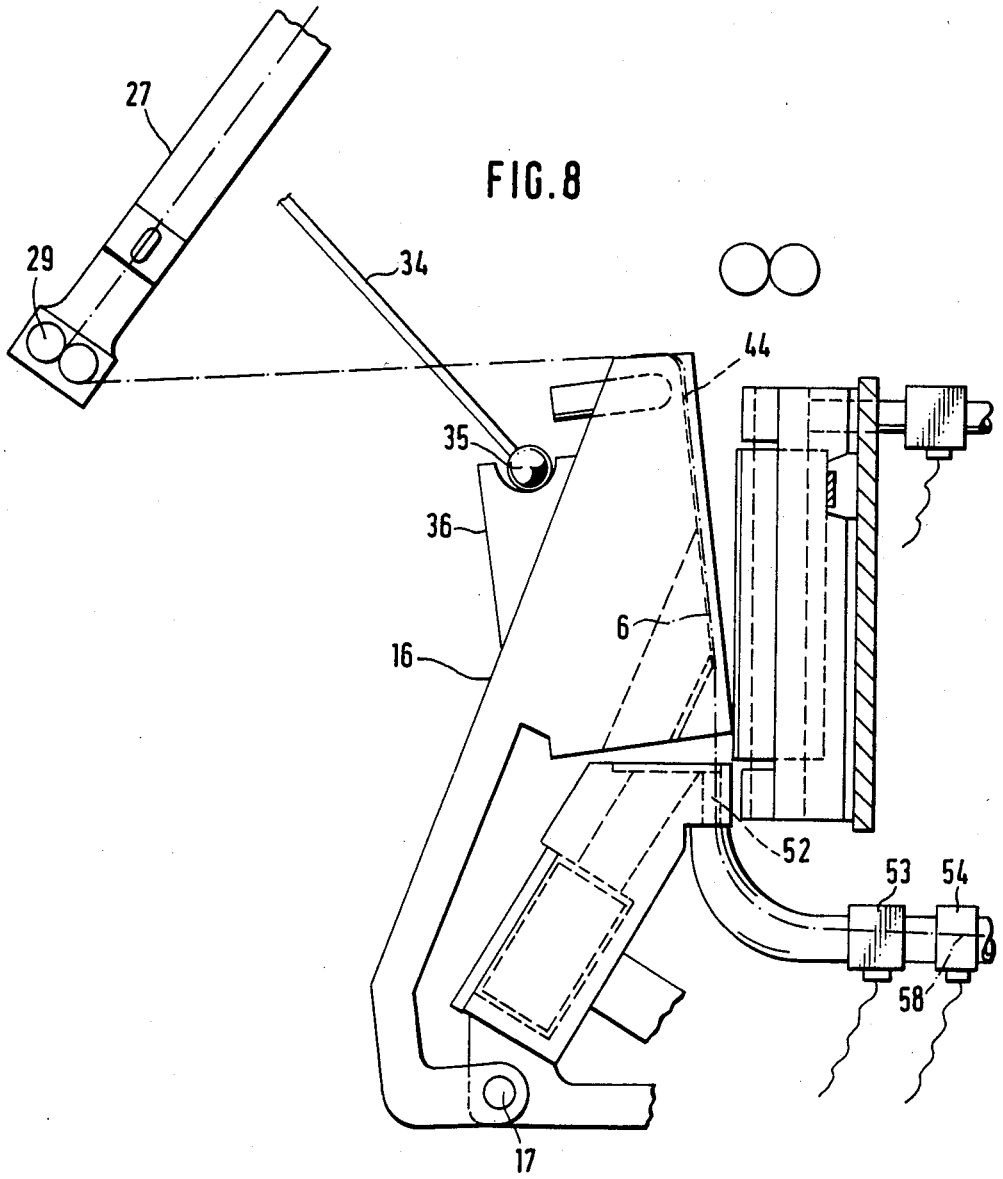
FIG. 8 is a side view of the spinning unit of FIG. 3 during closing of same when the cover-like element which carries along the straightened yarn end, is returned.
Figure 9:
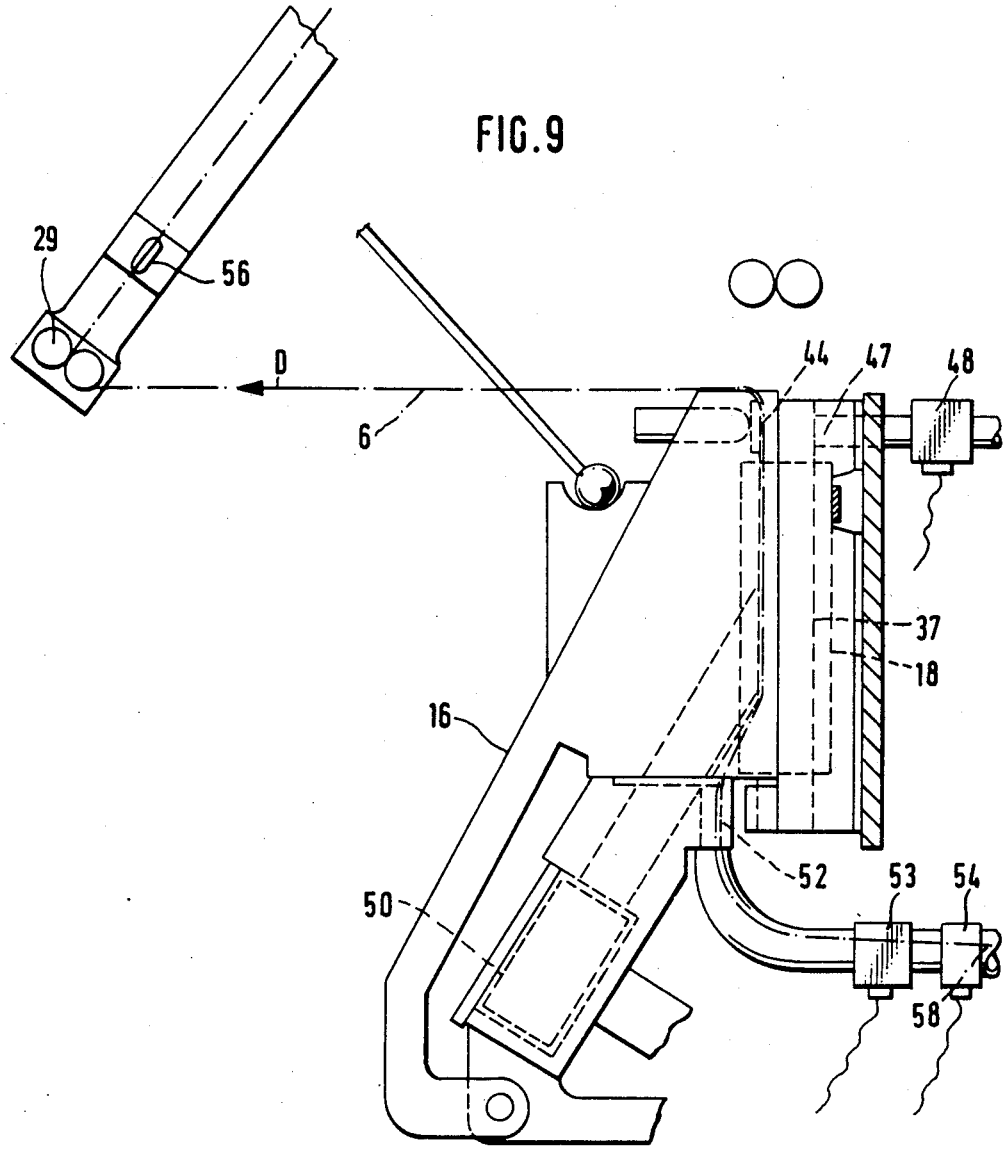
FIG. 9 shows the spinning unit of FIG. 3 in a closed condition with the withdrawn yarn end positioned in its operational location in front of the wedge slot.

After yarn end 6 is returned with a sufficient length in suction element 52 in accordance with arrow direction C (FIG. 6) a piece of yarn is tensioned between suction element 52 and the opened element 16 by pivoting along the path 57 (FIGS. 5 and 6) of subsidiary draw-off rollers 29. During the movement to the position in accordance with FIG. 7 subsidiary draw-off rollers 29 are opened by pressing them apart or are driven further in the direction of take-up. Subsequently maintenance device 2 returns element 16 to the position of normal operation (FIGS. 8 and 9). The element 16 is provided with a guide notch 44 (See also FIG. 4) carrying the tensioned yarn piece, which notch 44 in closed position of element 16 extends generally parallel to but at a distance from wedge slot 39 of the two rollers 18 and 18'. The so-returned yarn end 6 is now positioned in an acceptance position immediately adjacent the wedge slot 39 in guide notch 44 without touching the cover surfaces of rollers 18 and 18'. The so-returned yarn end 6 is therefore not exposed to any additional twisting.

In order to avoid the intake of yarn by means of the suction occurring in the area of wedge slot 39 of the suction device, i.e. of suction insert 37 into wedge slot 39, the effect of this suction device can be reduced or even interrupted by means of maintenance device 2 until the actual start spinning process. Maintenance device 2 hereby actuates the control valve 48 which is advantageously also electrically connected with its own switching member to the common switch 98 of maintenance device 2. It should be noted that switch valves 53 and 48 as well as control device 54 are only connected to a common switch unit, meaning that they have a common connection, however, they are actuable independently from each other and/or can independently put out signals.

Figure 10:
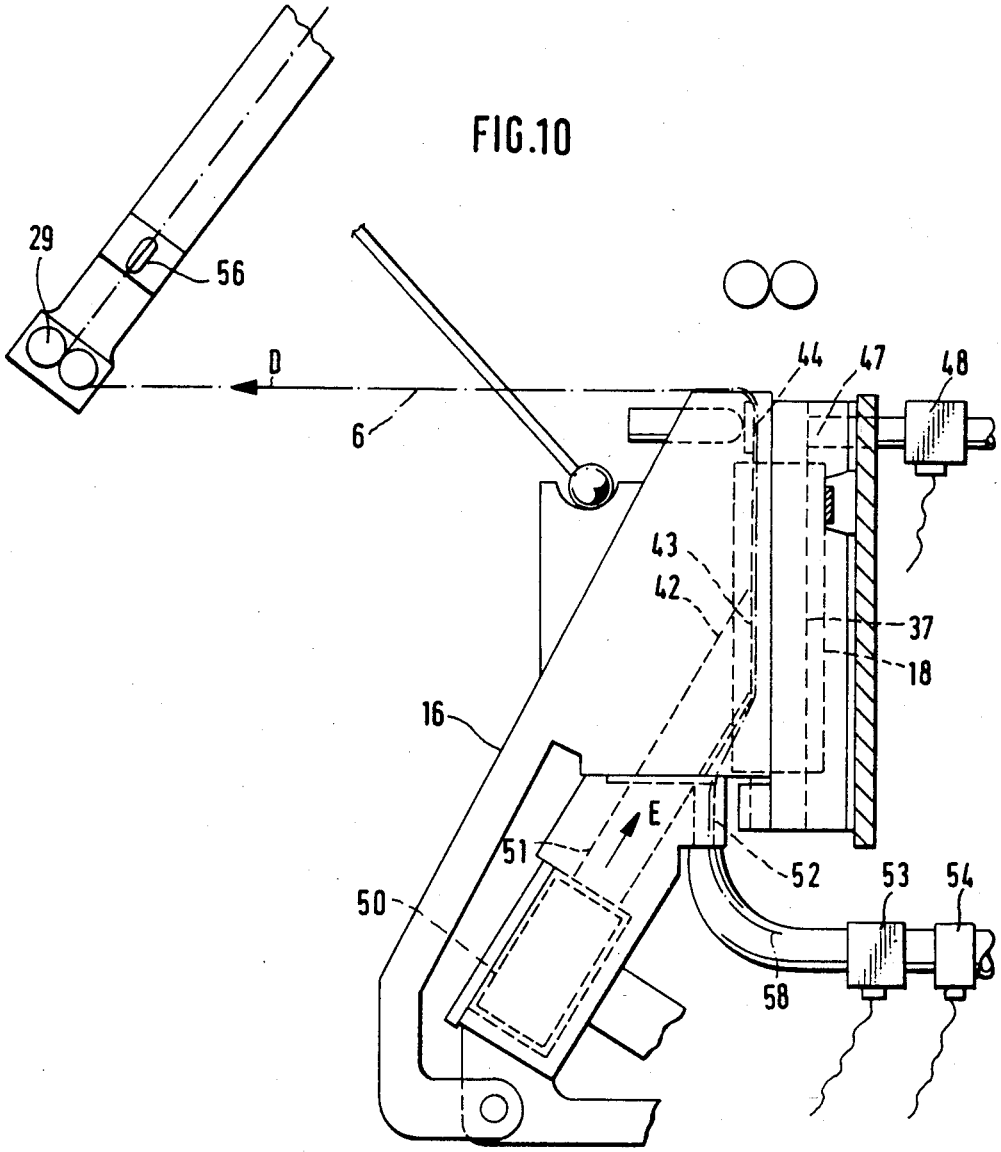
FIG. 10 shows the spinning unit of FIG. 3 during the start of the actual start spinning process.
Figures 11, 11A:
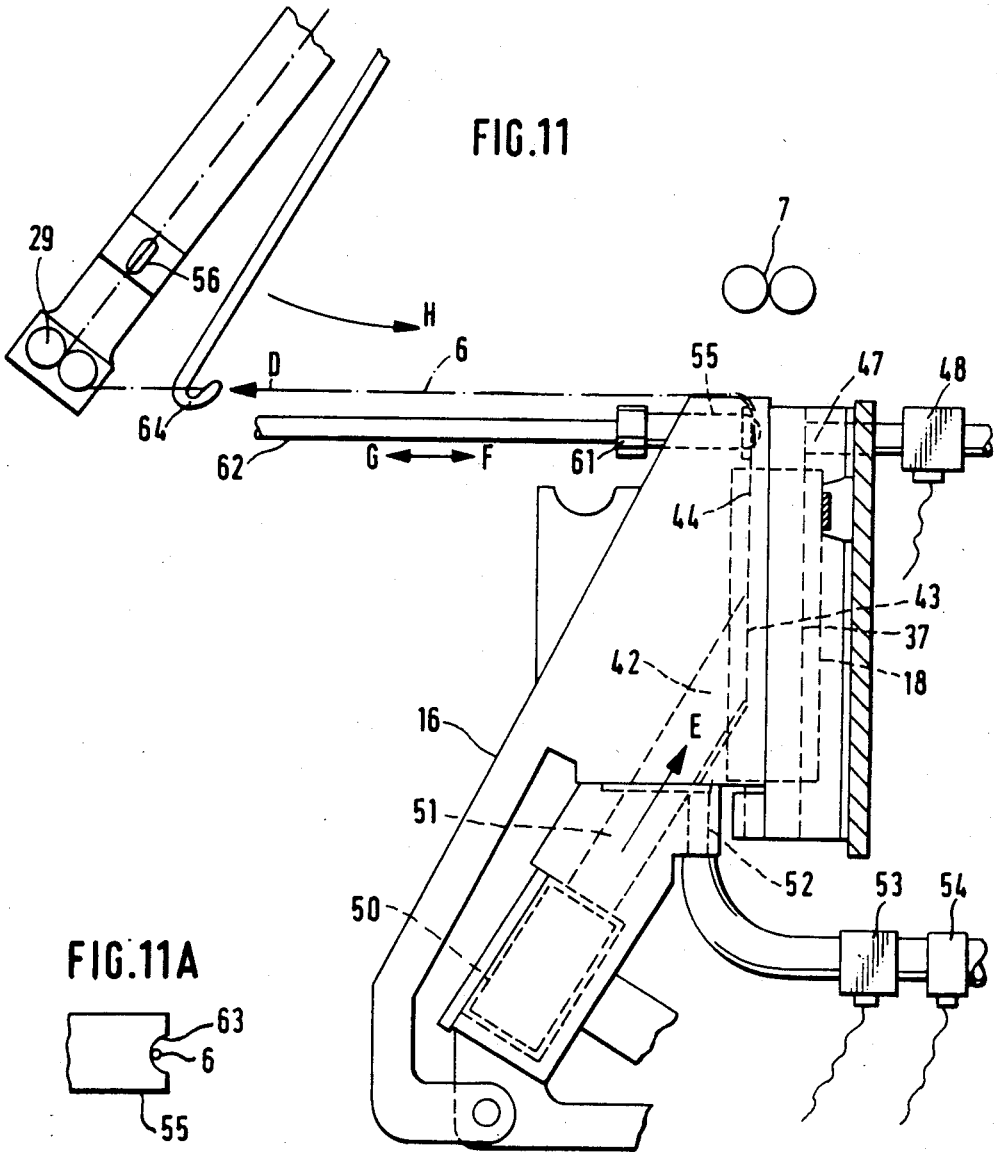
FIG. 11 shows the spinning unit of FIG. 3 after the start of start spinning but shortly prior to the return of the spun yarn end to the withdrawal device of the spinning unit.
FIG. 11A shows a detail of the spinning unit.

The returned yarn end 6 is now drawn-off by means of switching on subsidiary draw-off rollers 29 to the direction of draw-off whereby at the same time lift-off roller 22 is connected in the direction of take-up. In this first phase of yarn withdrawal the returned yarn end 6 is still within guide notch 44, that is to say it has not yet been transferred to the wedge slot 39. The transfer of yarn end 6 to wedge slot 39 is first initiated when end 58 of yarn end 6 comes close to the feed-in position for the single fibers, that means close to the opening 43 of fiber feed channel 51, 42. Control device 54 actuates the switch-on of fiber supply in arrow direction E (FIG. 10) in response to the location of end 58 of yarn end 6 or to a marking provided at an exact distance from the end of 58. The starting of the fiber feeding, that is the restarting of the feed roller (feed roller 76, FIGS. 13 and 14), or the unclamping of fiber band 5, is timed to occur with a desired time delay chosen to allow the feed-in fibers to reach the area of wedge slot 39 at the time when the end 58 of yarn end is located in the area of opening 43 or at the corresponding respective part of wedge slot 39. Delivery of yarn end 6 to wedge slot 39 takes place only shortly prior thereto namely when end 58 of yarn end 6 leaves suction nozzle 52, which at that time discontinues operation by means of control valve 53. In order to completely and reliably deliver yarn end 6 at this time to wedge slot 39, a thread guide 55 of maintenance device 2 is activated by means of a bar having a switch control member 61 and being slidable along the direction of arrows G and F (FIG. 11). Thread guide 55 also presses the returned yarn end 6 into wedge slot 39 in the area facing away from opening 43 of fiber feed channel 51, 42. Thread carrier or guide 55 (FIG. 11A), which includes a carrier recess 63 at its end, advantageously cooperates together with a guide element (carrier element) fixedly attached to bearing housing 41. The guide element is a ring-shaped thread guide which during operation centers the yarn to wedge slot 39. Thread carrier 55 is advantageously constructed in such a manner as to be locked-into operational position after actuation of switch element 61. Switch valve (relay valve) 48 is also open at the latest when actuation of supply at the single fibers has taken place so that the required suction effect is available in the area of wedge slot 39.

Figure 12:
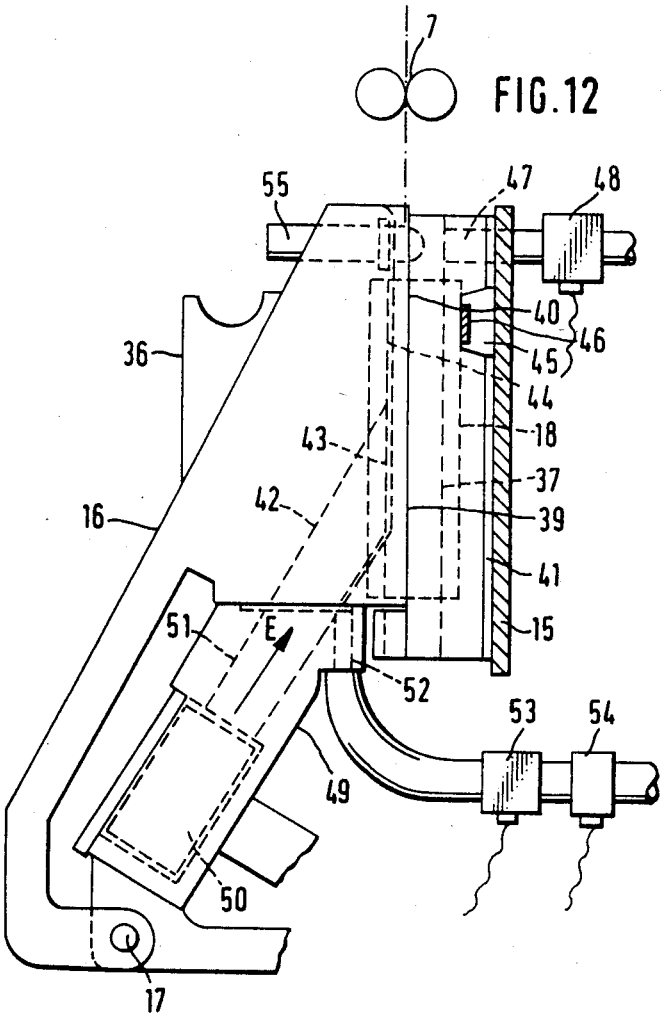
FIG. 12 shows the spinning unit of FIG. 3 after completion of the start spinning process and the return of the yarn to the spinning unit.

After completion of the start spinning process during which the yarn withdrawal in arrow direction D occurs exclusively via maintenance device 2, meaning through subsidiary draw-off rollers 29, and the winding process by means of lift-off rollers 22, the running yarn is transferred to spinning unit 1. For this purpose delivery arm 64 is provided, which takes over the running yarn from subsidiary draw-off rollers 29 and delivers same to the draw-off rollers 7 of spinning unit 1. Simultaneously lift-off rollers 22 are lowered to allow the return of take-up spool 9 upon grooved rollers 8. This completes the start spinning process (FIG. 12) and maintenance device 2 resumes its control function travel along the open end friction spinning machine.

It should be apparent from the preceding description that the return of the yarn end necessary for the start spinning process does not create any problems and is done with great precision because the area of wedge slot 39 is exposed. Furthermore, yarn end 6 is delivered to wedge slot 39 only shortly prior to the actual start spinning process, so that the same does not go through any rotation or twisting and practically exhibits the same characteristics as the yarn spun under normal operational circumstances. Furthermore, the exact time of actuation for starting the supply of single fibers in arrow direction E is coordinated with the position of bearded end 58 of yarn end 6, thus maintaining exactly the conditions of the actual start spinning of newly supplied fibers to yarn end 6. Since during start spinning, withdrawal occurs over subsidiary draw-off roller pair 29, the speed of yarn draw-off is controlled and adapted to start spinning conditions. It is advantageously proposed to operate with a higher speed of yarn draw-off during such time period while the newly supplied single fibers are being attached to yarn end 6, whereby the fibers envelope yarn end 6 in a first phase and then produce a new yarn first when yarn end 6 has left the feed-in area, i.e. the area of opening 43. A very tight connection is established particularly in connection with a treated and fiber-bearded yarn end without obtaining a thickening in the yarn.

Maintenance device 2 also operates the fiber feed-in. This, for example, is accomplished when maintenance device 2 is provided with a mechanical activating element, such as a slidable bar which allows the operational positioning of a not further illustrated yarn break sensor. The yarn break sensor actuates the fiber feed-in. Said activating element must then hold the yarn break sensor in operational position until it is again maintained in operational position by the yarn supplied to the spinning unit. Said element makes it possible to influence the amount of feed-in and to supply especially during the starting phase of feed-in a decreased fiber amount which first reaches the amount corresponding to the normal operational provisions, when end 58 of yarn end 6 passes the area of fiber feed-in, i.e., the area corresponding to opening 43. This also permits the effect that the amount of fibers first to envelope the yarn end being withdrawn during start spinning, is reduced to a minimum, while the full amount of fibers is supplied only after the returned yarn is no longer enveloped.

The process that was illustrated and described above essentially by referring to FIGS. 1 through 12 can also be used when a collective start spinning process is initiated after the entire machine is shut off. In this case, a yarn end each is introduced to the respective spinning positions at each unit prior to activating the drive of the machine, which yarn end extends in the area of rollers 18, 18' and the region of suction nozzle or pipe as illustrated in FIG. 9. However, then—as viewed in the direction of yarn draw-off—the yarn end is introduced downstream of wedge slot 39 into draw-off roller pair 7 and is guided directly to the take-up spools 9 which are positioned on top of grooved roller 8. The operation of rollers 18 and opening rollers 50, the effect of the suction device only in the area of the wedge slot, as well as the operation of draw-off roller pair 7 and of the grooved roller 8 is initiated. The feed-in of fiber band is actuated by means of a central control device with an appropriate timing factor which is again chosen to allow starting of feed-in of fibers to wedge slot 39 first when the end 58 of yarn ends 6 reach the area of openings 43 of the fiber feed channels 51, 42. Additionally, central actuators can be provided which control at appropriate times and simultaneously at all spinning units, thread carrier 55, relay switch valves 48, and switch relay valves 53.

Figure 13:
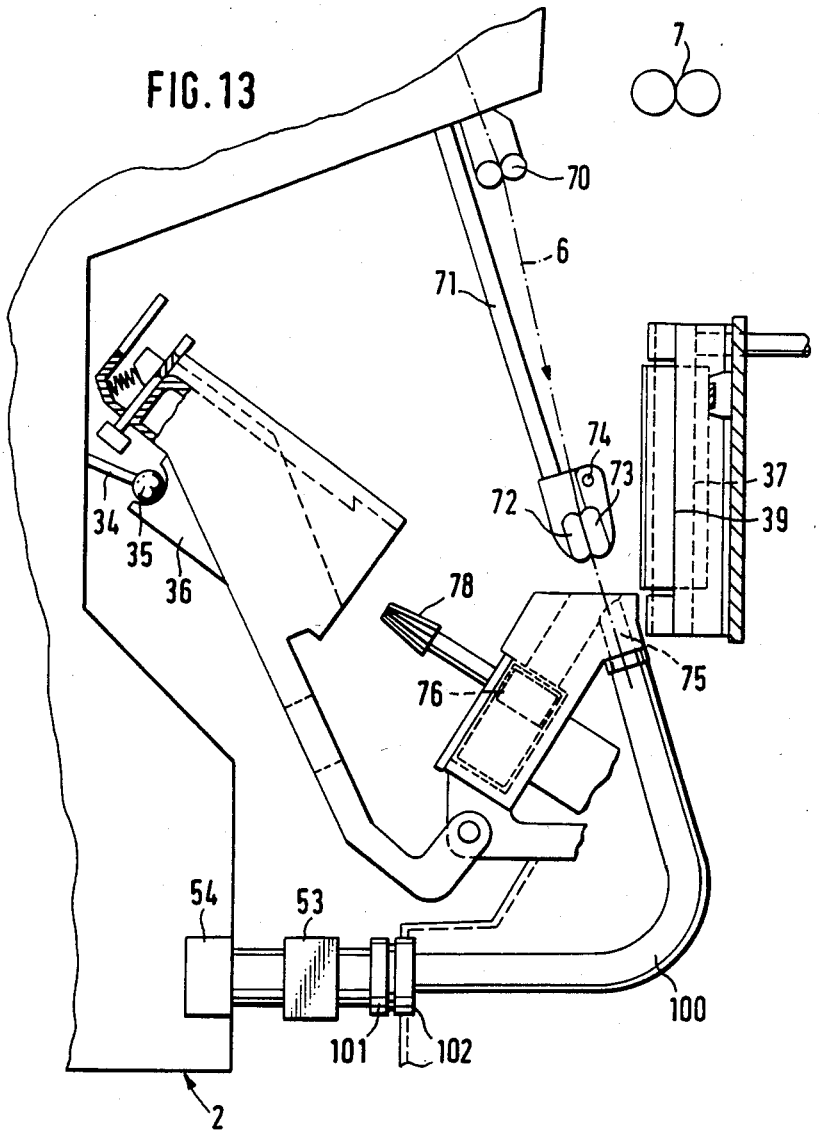
FIG. 13 is a sectional view of a further embodiment of a spinning unit with a partial depiction of a maintenance device that has also been changed to accomodate the start spinning process.

Component parts are provided at each spinning unit 1 according to the embodiment of FIGS. 3–12, namely relay valves 48 and 53, the control device 54, and suction nozzle 52 which are only used during start spinning. In order to further decrease manufacturing costs, a construction according to FIGS. 13 and 14 is proposed to transfer some of these elements to the maintenance device 2, while dispensing with the relay valve 48 which operates the suction device in the area of wedge slot 39. This construction provides that suction nozzle 75 forming a second yarn carrier element and arranged in the area of the end of wedge slot 39, facing away from draw-off rollers 7, is connectable over a connecting element 100 to a suction pipe of maintenance device 2, which includes the relay valve 53. The suction pipe including relay valve 53 is fixedly attached to spinning unit 1 by means of a connecting piece 101 and a counter part piece 102. Both connecting pieces 101 and 102 are constructed such that an opening to connecting pipe 100 is possible only after attachment. The control device 54 is also arranged in maintenance device 2 so that all together only one is provided for the entire open end friction spinning machine. The suction nozzle is also arranged with this construction in a stationary housing 49 surrounding opening roller 50 and connecting in the area of the first part 51 of fiber feed-in channel 51, 42. The second part 42 of fiber feed-in channel 51, 42 is open with a slot to wedge slot 39 of rollers 18, 18'.

This construction also provides that the feed roller 76 cooperates with a feed carrier which is not further illustrated, and is driven by means of an auxiliary drive of maintenance device 2 during the start spinning process. For that purpose the spindle of feed roller 76 is provided with an extension carrying a gear wheel 78 onto which a driving shell 79 can be mounted, shell 79 being connected to a driven and axially movable spindle 80 of maintenance device 2. This accessory drive permits an exact adaptation of fiber feed-in under desired conditions during the start spinning process, especially with respect to a reduced and later gradually increased fiber amount until the amount of fiber is satisfied during normal operation.

The construction according to FIGS. 13 and 14 further includes a thread guide 85 at the cover-like element 16 in the area of wedge slot 39 facing the draw-off roller pair 7, which guide is held in the operational position by means of a spring 86. Thread guide 85 preferably forms a sort of yarn draw-off channel together with other stationary guide elements at the bearing housing part for rollers 18. The thread guide 85 is withdrawn from its operational position prior to the actual start spinning process (FIG. 14) into which it is first returned when yarn end 6 is transferred to wedge slot 39. An excitable electromagnet 82 is provided upon a bar 81 of maintenance device 2 coordinated to permanent magnet 83 at the thread guide 85. Either through activation of electromagnet 82, or through axial movement of bar 81, thread guide 85 is brought into its operational position. Another slot-shaped thread guide 84 is provided at the cover-like element 16 at the side facing draw-off rollers 7, which guide 84 has a funnel-shaped widening which extends into a slot-shaped extension 87. Guide 84 serves to guide the yarn end which is returned and is to be transported in a tensioned state to guide surface 88 of thread guide 85 (FIG. 14A).

FIG. 14 especially shows that the yarn tension is loosened when the end 58 of the returned yarn end 6 during withdrawal gets close to the area of suction nozzle 75. Thus the yarn end 6 is sucked by means of suction effective in the area of wedge slot 39, into the area of slot 39 via suction insert 37 in an arched manner. The actual transfer of yarn end 6 to the wedge slot 39 occurs only after the end 58 of yarn end 6 leaves suction nozzle 75 and thread guide 85 returns to the operational position, As it is described in the embodiment according to FIG. 13 and 14, the auxiliary draw-off roller pair 70 of maintenance device 2 is stationarily arranged. In this case a thread clamp is arranged having two clamping jaws 72 and 73 arranged on a guide bar 71 which are movable towards each other about a pivot axle 74. The openable and closeable clamps are moveably adjustable by means of a guide rod 71 between the region of the auxiliary rollers 70 and the suction nozzle 75 fixed at the spinning unit 1. When the yarn end 6 is transferred over to the suction nozzle 75, the thread clamps are released and returned.

Figure 15:
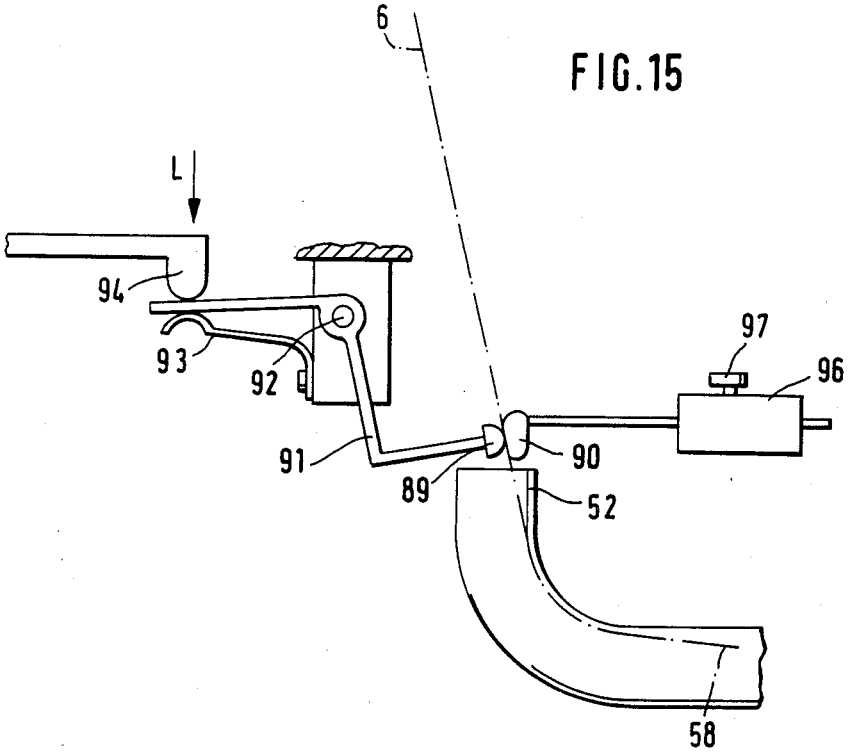
FIG. 15 is a partial depiction of a spinning unit with an additional yarn brake for the yarn end being returned or withdrawn.

In order to prevent that the return guided yarn end 6 is already sucked into the wedge slot 39 at an undesired point in time prior to the actual start spinning process, especially if the effective underpressure at that location is neither reduced nor shut off by means of the valve 48, auxiliary mechanical thread clamps can be provided in the region of the suction nozzles 52 or also 75, an illustrated in FIG. 15. These yarn or thread clamps include two clamping jaws 89 and 90 which receive the yarn end 6 therebetween so that the yarn end 6 remains tightly drawn during the withdrawal until the end 58 of the yarn end 6 leaves the yarn clamps 89, 90. In order not to hinder the threading of the yarn end 6 into the suction nozzle 52, it is provided that the yarn clamps either are first closed when the spinning unit 1 is closed through the return movement of the cover shaped construction part or is activated by the maintenance device 2. The clamping jaw 89 is arranged at one lever arm 91 of a pivot lever arm arrangement pivotable about pivot axis 92 and the other lever arm is actuable by means of an activating member 94 in the direction of arrow L against the effect of a spring 93 to thereby close the yarn clamps. In order to be able to adjust the exact dispostion of the clamping point, especially with respect to the wedge slot 39, the stationary clamping jaw 90 of the yarn clamp is adjustably slidably held in a holder 96 and is secureable in respective desired positions by means of a set screw 97.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Process for start spinning yarn at a spinning unit of an open end friction spinning machine of the type having a yarn forming region composed of friction surface means, fiber feeding means for feeding individual fibers to the yarn forming region, yarn withdrawal means for withdrawing formed yarn from the yarn forming region, and suction means for applying suction air flow to assist in holding the forming yarn in the yarn forming region, said process comprising:

interrupting the feeding of fibers to the yarn forming region by the fiber feeding means, exposing the yarn forming region by moving a cover part of the spinning unit from its closed normal spinning position to an open position, returning a previously formed yarn end portion to a predetermined intermediate position adjacent the exposed yarn forming region, moving the cover part to the closed normal spinning portion, transferring the yarn end portion from the intermediate position to the yarn forming region while activating the fiber feeding means to supply individual fibers to the yarn forming region to piece up with the yarn end portion, and activating the yarn withdrawal means to withdraw the yarn end portion and the pieced together newly forming yarn.

2. Process according to claim 1, wherein the yarn end portion is carried with the cover part during movement of the cover part to its closed normal spinning position.

3. Process according to claim 1, wherein the activating of the fiber feeding means commences when the extreme end of the returned yarn end portion is disposed in the region of the fiber feeding position of the yarn forming region, which yarn end has been return guided over the length of the yarn forming region and thereafter is withdrawn by the withdrawal means through the yarn forming region.

4. Process according to claim 1, wherein a reduced fiber supply volume is supplied by the fiber feeding means as compared to the operational fiber supply level until the extreme end of the yarn end portion is withdrawn out of the region of the fiber feeding position of the yarn forming region.

5. Process according to claim 1, wherein the extreme end of the yarn end portion is at least partly freed from the spinning rotation of the friction surface means before it reaches the region of the fiber feeding position of the yarn forming region.

6. Process according to claim 1, wherein the yarn end portion is withdrawn with a changed withdrawal velocity as compared to the operational yarn withdrawal velocity until the extreme end of the yarn end portion has left the region of the fiber feeding position of the yarn forming region.

7. Process according to claim 1, wherein the yarn end portion is held at a distance to the yarn forming region and without touching of the friction surface means and is only transferred to the yarn forming region shortly before the actual start spinning process when the extreme end of the yarn end portion arrives in the region of the fiber feeding position of the yarn forming region.

8. Process according to claim 1, wherein the transfering of the yarn end portion to the yarn forming region and at least the switching on of the yarn withdrawal means and the switching on of the fiber feeding means is carried out automatically in a predetermined sequence by means of a program control.

9. Process according to claim 1, wherein the yarn end portion is return guided with a length, which with a sufficient amount extends beyond the region of the fiber feeding position and the extreme end of the yarn end portion or a part thereof at a definite distance to the extreme end of the yarn end portion is provided with a marking which is detectable during the yarn withdrawal and is utilized as a signal for the initiation of one or several steps of the start spinning process.

10. Process according to claim 1, wherein the effect of the suction means is reduced or interrupted until immediately before the initiation of feeding of the fiber for the start spinning connection.

11. Apparatus for start spinning yarn at a spinning unit of an open end friction spinning machine of the type having a yarn forming region composed of friction surface means, fiber feeding means for feeding individual fibers to the yarn forming region, yarn withdrawal means for withdrawing formed yarn from the yarn forming region, and suction means for applying suction air flow to assist in holding the forming yarn in the yarn forming region, said apparatus comprising:

interrupting means for interrupting the feeding of fibers to the yarn forming region by the fiber feed means, a movable cover part for closing a housing around the yarn forming region during normal spinning operations, cover part moving means for exposing the yarn forming region by moving the cover part of the spinning unit to an open position, yarn end return means for returning a previously formed yarn end portion to a predetermined intermediate position adjacent the yarn forming region, yarn end transfer means for transferring the yarn end portion from the intermediate position to the yarn forming region while activating the fiber feeding means to supply individual fibers to the yarn forming region to piece up with the yarn end portion, and yarn withdrawal activating means for activating the yarn withdrawal means to withdraw the yarn end portion and the pieced together newly forming yarn.

12. Apparatus according to claim 11, wherein two yarn guide elemenets are provided which tension the return guided yarn end portion to a line therebetween, which line extends in a common plane between the yarn forming region of the friction surface means and a thread receptacle guide of the movable cover part, which line extends somewhat parallel to the yarn forming region when the parts are in a normal spinning position.

13. Apparatus according to claim 12, wherein the guide element at the end of the yarn forming region opposite the yarn withdrawal direction is fixedly arranged and the other guide element is arranged to be movable in the direction of the yarn end portion to be tensioned.

14. Apparatus according to claim 13, wherein the fixed guide element is a suction nozzle.

15. Apparatus according to claim 14, wherein the movable guide element includes a drivably arranged roller pair at an adjusting arm.

16. Apparatus according to claim 14, wherein the suction nozzle is connected at an under pressure line containing a switch valve.

17. Apparatus according to claim 16, wherein the suction means effective in the yarn forming region is connected at an under pressure line containing a switch valve.

18. Apparatus according to claim 14, wherein at least in the region of the yarn withdrawal facing end of the yarn forming region, an adjustable yarn guide is provided for movably guiding the yarn from the yarn carrying guide groove to the yarn forming region.

19. Apparatus according to claim 14, wherein the suction nozzle is arranged adjacent yarn brakes for the yarn end portion.

20. Apparatus according to claim 19, wherein the yarn brakes are adjustable in relative position with respect to the yarn forming region.

21. Apparatus according to claim 13, wherein the movable guide element includes a drivably arranged roller pair at an adjusting arm.

22. Apparatus according to claim 13, wherein the movable guide element includes a yarn clamp at an adjusting arm which is adjustably movable with respect to the fixed guide element.

23. Apparatus according to claim 12, wherein the suction means effective in the yarn forming region is connected at an under pressure line containing a switch valve.

24. Apparatus according to claim 12, wherein the cover part is provided with a yarn carrying guide groove which extends approximately parallel to the yarn forming region when the cover part is in a closed driving position.

25. Apparatus according to claim 12, further comprising a device for breaking down and unraveling the extreme yarn end.

26. Apparatus according to claim 12, further comprising a marking device for marking a position of the return guided yarn end portion at a predetermined distance from the extreme end.

27. Apparatus according to claim 26, wherein the marking device exhibits a coating device which coats a marking material on the yarn end portion, which marking material exhibits a characteristic optical, electrical or acoustic feature deviating from that of the fiber material.

28. Apparatus according to claim 27, wherein a control device for detecting one of the extreme end of the yarn end portion and the marking provided at the yarn end portion is provided in the path of the yarn end portion upstream of the fiber feeding position, said control device being capable of detecting the traveling by of the end or the marking of the yarn end portion and giving a corresponding signal to an automatic program control means for controlling the sequence of start spinning steps.

29. Apparatus according to claim 12, wherein a maintenance device is provided which is movable along the open end friction spinning machine and is adjustably movable to the spinning units needing servicing, said maintenance device being outfitted with devices for the carrying out of the start spinning process at the spinning unit.

30. Apparatus according to claim 29, wherein the maintenance device is outfitted with: devices for removing and unwinding the yarn end portion from a winding spool of the spinning unit needing servicing, devices for the extension and unraveling of the extreme end of the yarn end portion, devices for the tensioning of the yarn end portion in the region between the yarn forming region and the movable cover part of the spinning unit, and devices for further withdrawing the yarn end portion from the spinning unit and for the winding of the yarn at the winding spool.

31. Apparatus according to claim 30, wherein the maintenance unit is provided with an apparatus for adjusting a yarn guide carrier to transfer the yarn end portion to the yarn forming region for start spinning.

32. Apparatus according to claim 31, wherein the maintenance unit is provided with a suction line containing a switching valve which is connectable by means of a guiding connection line at respective suction nozzles of the spinning units to be serviced.

33. Apparatus according to claim 29, wherein the maintenance unit is provided with a device for activating a switching valve of the suction means effective in the region of the yarn forming region.

34. Apparatus according to claim 29, wherein the maintenance unit is provided with a device for activating a switching valve of a suction nozzle serving as a yarn guide for the return of the yarn end portion for start spinning.

35. Apparatus according to claim 29, wherein the maintenance unit is provided with a device for switching on the drive of the fiber feeding means of the spinning unit ready to be serviced.

36. Apparatus according to claim 35, wherein the maintenance unit is provided with an adjustable auxiliary drive for the fiber feeding means of the spinning unit to be serviced.

37. Apparatus according to claim 29, wherein a corresponding control device is arranged in the maintenance unit for detecting the extreme end or a marking section of the yarn end portion.

38. Process according to claim 1, wherein the friction surface means comprises a pair of adjacently arranged friction rollers rotatable in the same direction, and the yarn forming region comprises a wedge slot between the pair of rollers.

39. Process according to claim 38, wherein the yarn end portion is carried with the cover part during movement of the cover part to its closed normal spinning position.

40. Apparatus according to claim 11, wherein the friction surface means comprises a pair of adjacently arranged friction rollers rotatable in the same direction, and the yarn forming region comprises a wedge slot between the pair of friction rollers.

41. Apparatus according to claim 40, wherein two yarn guide elements are provided which tension the return guided yarn end portion to a line therebetween, which line extends in a common plain between the wedge slot of the rollers and a thread recipticle guide of the moveable cover part, which line extends somewhat parallel to the wedge slot when the parts are in a normal spinning position.

* * * * *